US010400460B2

(12) United States Patent
Hayman et al.

(10) Patent No.: US 10,400,460 B2
(45) Date of Patent: Sep. 3, 2019

(54) PIVOTING HORIZONTAL AND VERTICAL SCAFFOLD MEMBERS AND A METHOD OF ERECTING AN OFFSET SCAFFOLD PLATFORM

(71) Applicants: Yates W. Hayman, Walker, LA (US); Johnny Curtis, Walker, LA (US); Stephen Thacker, The Woodlands, TX (US)

(72) Inventors: Yates W. Hayman, Walker, LA (US); Johnny Curtis, Walker, LA (US); Stephen Thacker, The Woodlands, TX (US)

(73) Assignee: Saferite Platforms, Inc., Vista, CA (US)

( * ) Notice: Subject to any disclaimer, the term of this patent is extended or adjusted under 35 U.S.C. 154(b) by 0 days.

(21) Appl. No.: 15/053,894

(22) Filed: Feb. 25, 2016

(65) Prior Publication Data

US 2016/0177581 A1 Jun. 23, 2016

Related U.S. Application Data

(63) Continuation of application No. 14/265,074, filed on Apr. 29, 2014, now abandoned, which is a (Continued)

(51) Int. Cl.
*E04G 7/30* (2006.01)
*E04G 1/14* (2006.01)
(Continued)

(52) U.S. Cl.
CPC ..... *E04G 7/302* (2013.01); *E04G 1/14* (2013.01); *E04G 5/001* (2013.01); *E04G 5/007* (2013.01);
(Continued)

(58) Field of Classification Search
CPC ..... E04G 7/306; E04G 7/302; E04G 7/307
See application file for complete search history.

(56) References Cited

U.S. PATENT DOCUMENTS 3,978,634 A * 9/1976 Mack ..... E04G 1/15 182/128
4,140,414 A * 2/1979 Buttgereit ..... A47B 57/50 211/182
(Continued)

FOREIGN PATENT DOCUMENTS

DE 19637543 A1 3/1998
DE 19703558 A1 * 8/1998 ..... E04D 13/12
(Continued)

OTHER PUBLICATIONS

Machine translation of JP2009-299307.*
Machine translation of DE 19703558-A1.*
Machine translation of JP2009299307A.*

*Primary Examiner* — Marcus Menezes
(74) *Attorney, Agent, or Firm* — Jones Walker LLP

(57) ABSTRACT

One embodiment of the invention is a horizontal scaffold truss that has upper and lower horizontal scaffold members offset but fixedly joined with braces. Each upper and lower members have a connector positioned on each end of the respective lower and upper members, where at least one of the connectors is pivotally mounted on the respective lower or upper connector, and the connecters are engageable with an annular member positioned on a vertical scaffold member.

6 Claims, 15 Drawing Sheets

Related U.S. Application Data continuation-in-part of application No. PCT/US2012/062557, filed on Oct. 30, 2012.

(60) Provisional application No. 61/599,118, filed on Feb. 15, 2012, provisional application No. 61/628,607, filed on Nov. 2, 2011.

(51) Int. Cl.
*E04G 7/32* (2006.01)
*E04G 5/00* (2006.01)

(52) U.S. Cl.
CPC ..... *E04G 7/306* (2013.01); *E04G 7/307* (2013.01); *E04G 7/32* (2013.01); *Y10T 29/49826* (2015.01); *Y10T 403/32163* (2015.01)

(56) References Cited

U.S. PATENT DOCUMENTS 4,525,096 A * 6/1985 Green ..... E04G 7/307 182/186.8
5,172,997 A * 12/1992 Brasil ..... E04G 7/307 403/246
5,207,527 A * 5/1993 Duncan ..... E04G 7/307 182/186.8
5,605,204 A * 2/1997 Ausejo ..... E04G 7/307 182/186.7
5,645,271 A * 7/1997 Nunez ..... E04H 17/1421 256/24
5,961,240 A * 10/1999 Bobrovniczky ..... E04G 7/307 182/186.8
6,305,868 B1 * 10/2001 Kinoshita ..... E04G 7/305 403/196
6,450,291 B1 * 9/2002 Ono ..... E04G 1/06 182/178.1
9,103,080 B2 * 8/2015 Jolicoeur ..... E01D 19/106
2004/0163889 A1 * 8/2004 Wallther ..... E04G 5/14 182/113
2005/0217936 A1 * 10/2005 Jolicoeur ..... E01D 19/106 182/130
2016/0002936 A1 * 1/2016 Cox ..... E04G 1/06 182/130

FOREIGN PATENT DOCUMENTS

DE 19703558 A1 8/1998
DE 19946929 A1 * 4/2001 ..... E04G 7/08
DE 10115232 A1 * 10/2002 ..... E04G 7/22
EP 623716 A1 11/1994
FR 2522708 A1 * 9/1983 ..... E04G 7/307
GB 2066341 A * 7/1981 ..... E04G 5/16
JP 2009-299307 * 12/2009 ..... E04G 7/34
JP 2009299307 A * 12/2009 ..... E04G 1/24

* cited by examiner

HINGE DETAIL

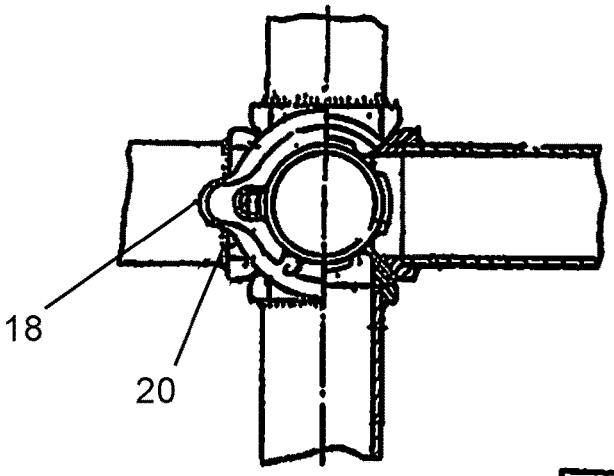
FIGURE 10B
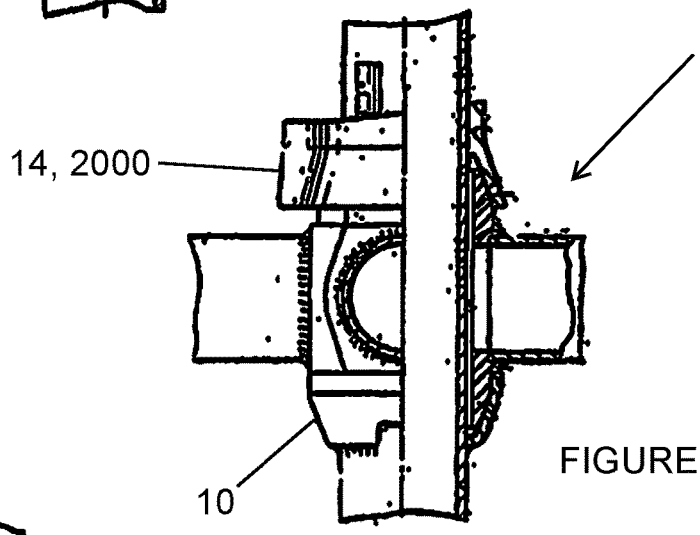
FIGURE 10A
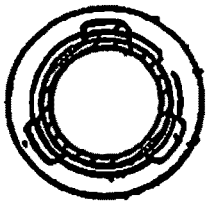
FIGURE 10C
FIGURE 10
Prior Art FIGURE 11A
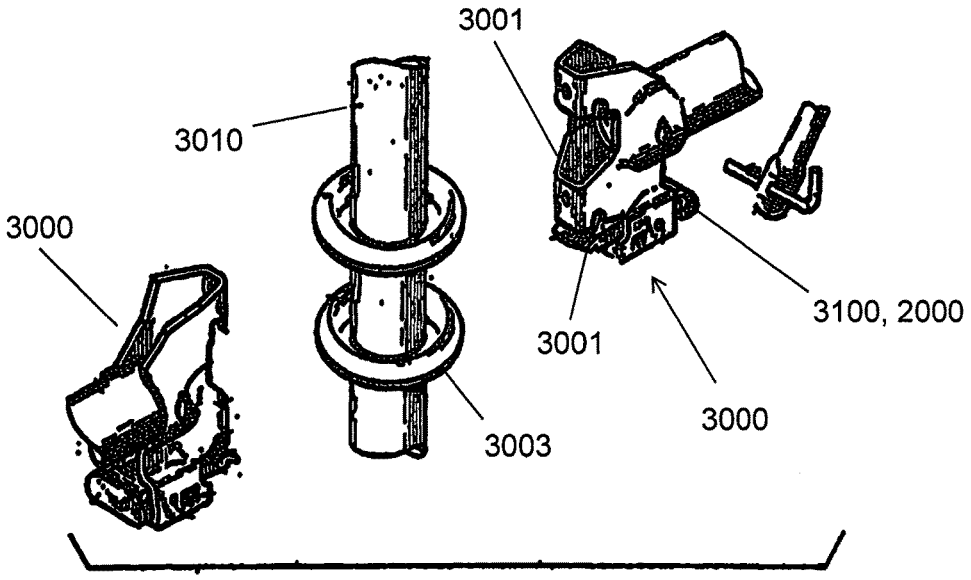
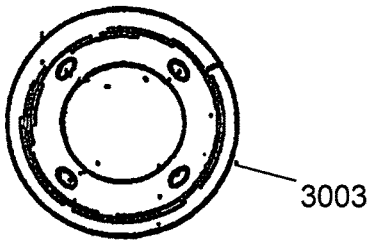
FIGURE 11C
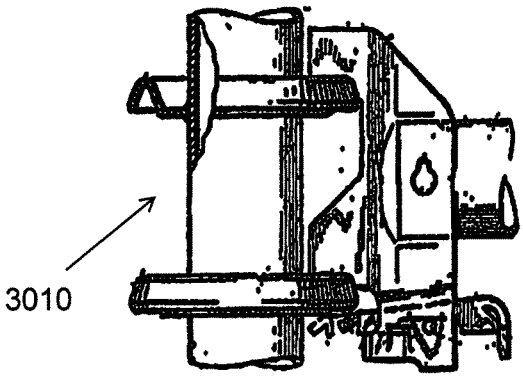
FIGURE 11B
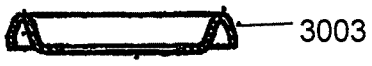
FIGURE 11D
FIGURE 11
Prior Art

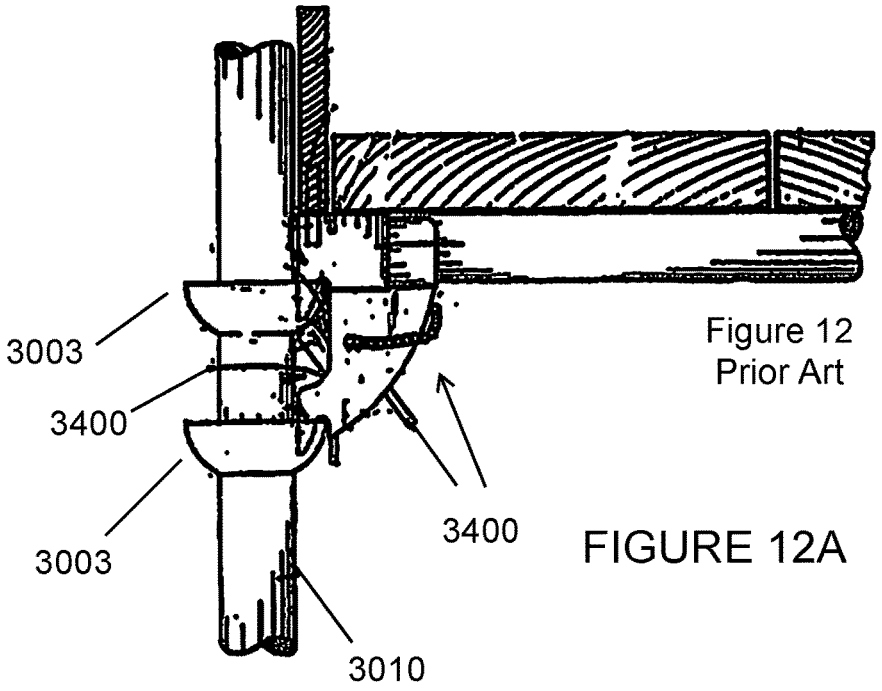
Figure 12
Prior Art
FIGURE 12A
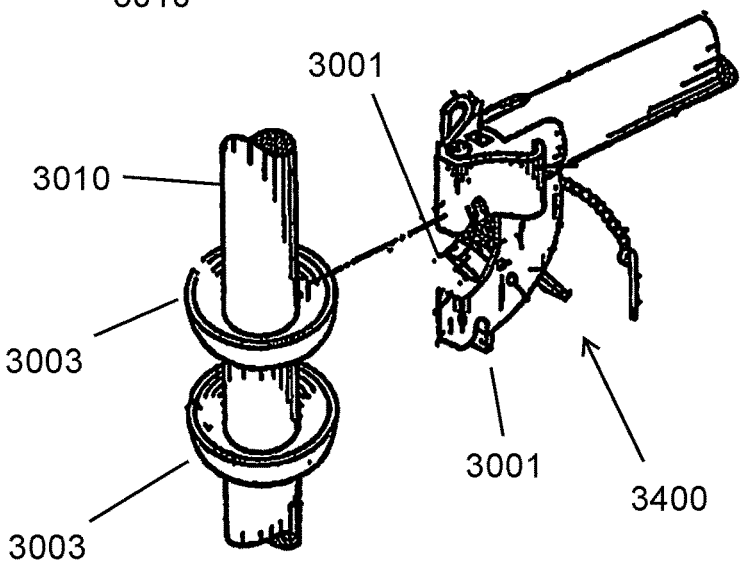
FIGURE 12B

PIVOTING HORIZONTAL AND VERTICAL SCAFFOLD MEMBERS AND A METHOD OF ERECTING AN OFFSET SCAFFOLD PLATFORM

CROSS REFERENCE TO RELATED APPLICATIONS

This application is a continuation of U.S. application Ser. No. 14/265,074, filed on Apr. 29, 2014, which was a continuation in part of Application PCT/US2012/062557, filed on Oct. 30, 2012, which claimed the priority benefit of U.S. Provisional Application 61/599,118 filed on Feb. 15, 2012, and U.S. Provisional Application 61/628,607 filed on Nov. 2, 2011, all of which are incorporated by reference.

BACKGROUND

Scaffold frames are a series of horizontal and vertical scaffold frame members that connect together to create a raised working platform. The overall structure is supported by the vertical scaffold members contacting the support surface, such as the ground.

Scaffold frames can be constructed from tube and clamp frame members, or from system scaffold members (modular scaffold systems). In system scaffolds, the vertical scaffold members are coupled to horizontal scaffold members at a scaffold joint. A modular scaffold joint comprises a connector on the vertical scaffold member 3000 that is designed to couple or mate with a connector on a horizontal scaffold member, thereby joining together a horizontal and vertical scaffold member 2010. Horizontal scaffold members will be referred to in general as "horizontals," while vertical scaffold members will be referred to generally as "verticals" irrespective of the joint/connector type.

One type of modular scaffold joint uses an end connector positioned on the end of a horizontal member, where the end connector has a lip or hook section 3001. The lip sections are designed to engage or rest on the corresponding vertical joint connector, such as an upstanding cup or an annular ring positioned 3003 on a vertical scaffold member 3010. One such joint is disclosed in U.S. Pat. No. 4,445,307, shown in FIG. 11, which discloses a connector positioned on a horizontal scaffold member, where the connector has two vertically spaced hook sections 3001.

These hook sections couple with two vertically spaced upstanding cup or ring members 3003 located on the vertical scaffold member 3001. To lock the joint in place, the connector includes a wedge 3100 (a form of a moveable latch member 2000) that is driven (generally by a hammer) into position below the upper ring member, thereby wedging the ring against the end connector hood section, latching the horizontal member to the vertical member. This type of connector is referred to as a Safway connector (see attached FIG. 11). As used herein, "latching" refers to the action of engaging a horizontal member to a vertical member, where the action of latching resists dislodgement of the horizontal member from the vertical member from an upwardly directed force.

Another cup type of latching connector is disclosed in U.S. Pat. Nos. 5,078,532 and 5,028,164 and in U.S. application Ser. No. 12/489,166 all hereby incorporated by reference (see FIG. 12). These patents also show an end connector positioned on a horizontal scaffold member, where the connector has two vertically spaced hooked sections 3001 that couple with two vertically spaced upstanding cup or ring members 3003 located on the vertical scaffold member 3010. In this device, the hooked sections engage the top edge of the cup, and a pivoting member or latch 3400, (the pivoting latch 3400 is another type of movable latch member 2000) positioned on the horizontal end connector, is pivoted into position below the cup member. The latch member 3400 has a distal end extending beyond the housing, shaped to allow for placement of the distal end beneath a cup positioned on a vertical scaffold member. Hence, when latched, the cup 3003 is trapped between the hook engagement sections of the connector housing and the distal end of the latch member 3400 (see FIG. 12A). The latch pivots on a pivot pin, and can be spring loaded to bias the latch into a locking or actuated position. This type of connector is referred to as an Excel connector (see attached FIG. 12). Single cup embodiments are also possible, such as shown in U.S. Pat. No. 7,048,093. Other cup type latching mechanism are in the prior art, including U.S. Pat. No. 4,369,859.

Another "cup" type of latching mechanism is disclosed in U.S. application Ser. No. 11/738,273, filed Apr. 20, 2007 (hereby incorporated by reference)(not shown). This application teaches a horizontal scaffold member having an end connector with two hook or engagement areas, each designed to couple with a cup on a vertical member. The connector includes an upper and a lower latch, each the respective upper and lower coupled ring or cup members. The two latches are mechanically coupled allowing for single action operation to engage or disengage both latches simultaneously. In general, a system scaffold using a cup on the vertical member with a latch on the horizontal scaffold member (whether slidable or pivotable, (as a type of movable latch member 2000) will be referred to as a cup/latch scaffold system. This is also in the scope of an Excel connector.

Another cup-type of latching connector is disclosed in U.S. Pat. No. 3,992,118 (commonly referred to as the Cuplock system)(see FIG. 10). As disclosed in this patent (see particularly FIGS. 3 and 4 of this patent), the vertical scaffold member (generally a pipe) has a fixed annular ring 10 forming an upstanding cup surrounding the vertical member with upward facing annular channel. Positioned above this upstanding cup at a set height is a lug 20. Slidably and rotationally positioned on the vertical scaffold member above this fixed cup, is a reverse cup (a cup facing downwardly) 14 that has a downward facing annular channel (the rotatable cup is another type of movable latch member 2000), and an outward projection 18 in the cup wall that forms a slot 17. This slot accommodates the lug 20, so that the reverse cup, with the slot aligned with the lug, can slide past the lug, and if the slot is not aligned with the lug, the reverse cup 14 cannot slide past the lug 20 (see FIG. 10A). The corresponding horizontal scaffold member (generally a pipe) has at each end, an upward facing ear or tongue and a downward facing ear or tongue (not shown). Each respective tongue is shaped to fit in the annular channel formed in the respective upward and reverse cup. To assemble a joint, the downward tongue on the horizontal member is positioned in the upward annular channel of the upstanding cup. The reverse cup is then slid down the vertical member, past the lug 20 (by proper alignment of the slot 17), to capture the upstanding tongue within the downward facing annular on the reverse cup. The reverse cup 14 is then rotated on the vertical horizontal member until the slot 17 is not aligned with lug 20, thereby "locking" the tongues of the horizontal between the upstanding cup, and the reverse cup (hence the name cuplock)(the rotating cup is another form of movable latch member 2000). (See attached FIG. 10). Instead of upstanding cups, a flat annular ring with openings in the ring may be used as the vertical connector on the vertical scaffold member, to couple to a connector on a horizontal scaffold member. Examples of annular ring/connector systems are shown in U.S. Pat. Nos. 4,273,463; 6,027,276; 5,961,240; 5,605,204; 4,840,513; and PCT publication number WO 2011/094351. All of which are hereby incorporated by reference. These systems are generally referred to as wedge or pinlock scaffold systems, (for an example, see FIG. 9). The pinlock system relies upon a wedge or pin 4000 being slidable (generally hammer driven) through the horizontal end connector and rosette 4010 (the slidable pin is another type of movable latch member 2000). For instance, the joint of U.S. Pat. No. 5,961,240 (see FIG. 1 of that patent, attached as FIG. 9 hereto), uses rosette rings 4010—positioned on a vertical scaffold member. The ring 4010 has a series of openings 4022 therethrough. The horizontal end connector is a body with a horizontal slot or mouth in the body to accommodate the rosette ring. Slidably positioned on the horizontal end connector is a pin 4000, which is vertically slidable through a vertical slot and in the connector body (the slidable pin 4000 is another form of a moveable latch member 2000). In joining a vertical member to a horizontal member, the rosette 4010 is slid into the mouth of the horizontal connector, with an opening 4010 in the rosette aligned with the vertical slot in the end connector. The pin 4000 is then rotated upwardly, and then through the vertical slots, which wedges and holds the horizontal member to the vertical member.

System scaffolds are used to allow for ease of erection of scaffold platforms. However, in some instances, it is not possible to erect a horizontal scaffold platform where the horizontal scaffold members are supported on four (or more) corners by downwardly extending ground supported vertical scaffold members. For instance, an elevated working surface may be needed that is connected to a self-standing scaffold structure, but where the platform is offset or cantilevered from the scaffold frame structure in order to extend the working platform over a structure (such as a tank). An offset working surface may be created by using a triangular shaped frame member connected to the scaffold frame structure (generally, two vertical members of the frame) to create an offset "knee out" structure that will support a cantilevered horizontal working surface. One such structure is shown in U.S. application Ser. No. 12/824,314 filed on Jun. 28, 2010, hereby incorporated by reference. However, when the offset working surface needs to extend more than about ten feet from the scaffold frame, a knee out support structure may not be feasible.

If the working environment includes overhead structures (often seen in bridge and offshore platforms), offset scaffold working surfaces with long platforms can be constructed by suspending the remote end (or intermediate portion) of the offset extended platform from the overhead structure. The suspended offset scaffold working surface makes long extended platforms feasible, but construction is arduous and dangerous. One method of erecting such an offset and suspended platform is as follows. A self-standing scaffold structure is constructed adjacent to the overheard structure, with a working surface positioned at the desired height for the offset platform. From this working surface, a worker will couple an outwardly extending horizontal member to one of the vertical legs of the scaffold, to form an outwardly extending horizontal member supported only at one end by the couple to the vertical scaffold member. Placement of the extended horizontal, for instance, an eight foot long horizontal member, is awkward due to the weight of the horizontal member, and the fact that the horizontal member must be held in position perpendicular to the vertical member in order to couple to the vertical member, thus presenting large torque forces during installation. With a horizontal extending outwardly, a worker would tie off to the scaffold structure, and walk out on the extended horizontal (which is coupled to the scaffold frame at only one end). The worker would then connect a vertical to the free end of the horizontal, and then support the vertical from the overhead structure (such as by tying a rope or chain between the overhead structure and the vertical). The worker would return to the platform, and install a second outwardly extending horizontal, and similarly, attach a vertical to the remote end of this horizontal, and suspend this vertical from the overhead structure. Scaffold planks are then laid over the two suspended horizontals, creating a deck or working surface. A worker would then take a third horizontal, and connect the two suspended verticals to form a more rigid support frame for the working surface. Handrails can then be installed as desired between the verticals of the scaffold main frame and the suspended verticals.

As can be seen, this erection method requires a rigid joint between the horizontal and vertical scaffold member to allow a worker to safely walk out on an extended horizontal. For this reason, the preferred joint for this structure is the pinlock system, such as shown in U.S. Pat. No. 5,961,240, (one embodiment of a pinlock is shown in FIG. 9) as a tight joint is needed to support a worker while working out on the extended horizontal. During the construction, the worker will generally be tied off to the overhead structure. However, even tied off, the procedure is dangerous and awkward. To join a horizontal to a vertical, the horizontal member must be held at a right angle to the vertical to allow the horizontal connector to couple to the vertical rosette or cup. This is difficult to accomplish due to the weight of the horizontal, and the length of the horizontal (7-10) feet. A safer apparatus and method of assembly is needed for building offset suspended scaffold decks.

Collectively, cups and rosettes, or other types of annular members on the vertical scaffold member used to couple to a horizontal end connector will be referred to collectively as annular members.

BRIEF DESCRIPTION OF THE DRAWINGS

FIG. 5 shows one embodiment of a bracket used to mount a connector for vertical pivoting.

FIG. 10A is a side view of one embodiment of a cup lock type scaffold joint (taken from FIGS. 3, 4, and 5 of U.S. Pat. No. 3,992,118).

FIG. 10B is a top view of one embodiment of a cup lock type scaffold joint shown in FIG. 10A.

FIG. 10C is a top view of one embodiment of a cup lock type scaffold ring in FIG. 10A.

FIG. 11A is an exploded perspective view of one embodiment of a Safway type scaffold joint (taken from FIGS. 1, 2, 9 and 10 of U.S. Pat. No. 4,445,307).

FIG. 11B is a side view of the assembled joint of FIG. 11A.

FIG. 11C is a top view of a cup used in FIG. 11A, while FIG. 11D is a side view of the same cup.

FIG. 12A is a side view of an assembled embodiment of an Excel type scaffold joint (taken from FIGS. 1 and 2 of U.S. Pat. No. 5,078,532).

FIG. 12B is a perspective exploded view of the embodiment of an Excel type scaffold joint shown in FIG. 12A.

DESCRIPTION OF THE PREFERRED EMBODIMENT

Figure 1:
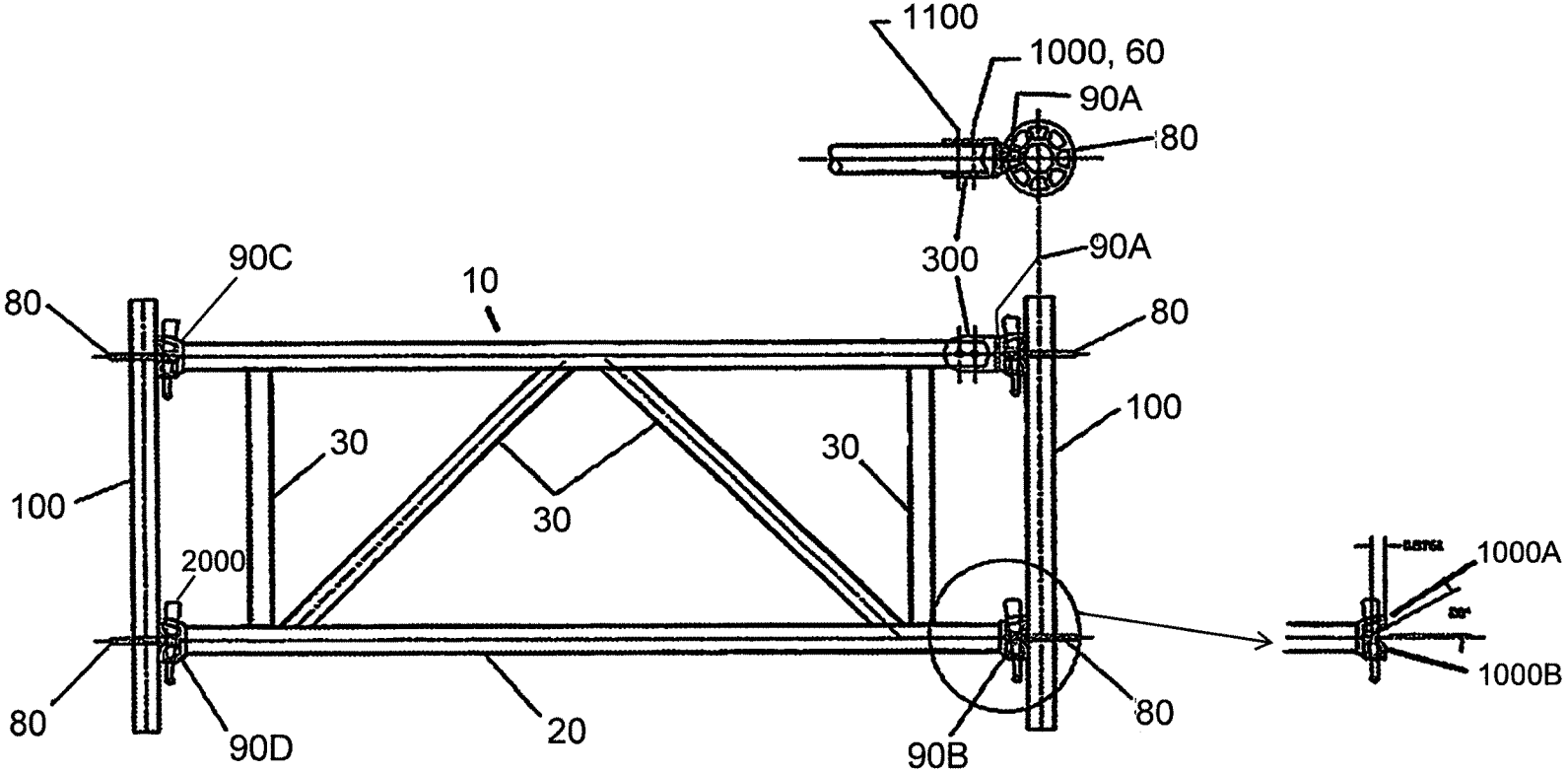
FIG. 1 is a side elevation of one embodiment of a horizontal truss with a vertically pivoting pinlock connector.

Shown in FIG. 1 is a horizontal scaffold truss member 1. The truss member 1 has two parallel horizontal pipes, and upper pipe 10 and lower pipe 20, and support elements or bracing members 30 positioned between the two horizontal pipes. Preferably, at each end of the horizontal pipe 10 and 20 are end connectors 90A, 90B, 90C and 90D (90A and 90C forming upper connectors on upper horizontal 10, and 90B and 9D forming lower connectors on lower horizontal 20). For convenience of description, the end connectors 90 shown are similar to those shown in U.S. Pat. No. 5,961,240, but the invention is not so limited. The "vertical" separation between the two horizontal pipes 10 and 20 is such so each end connector will mate with a corresponding annular member or connector 80 (here a rosette) on the vertical member 100, as shown in FIG. 1.

As shown, three of the end connectors 90B, 90C, and 90D, are fixedly joined to the respective end of the horizontal pipe. However, one upper end connector, 90A, is pivotally coupled to the end of the upper horizontal pipe 10. As shown in FIG. 1, upper end connector 90A allows the upper horizontal pipe 10 to pivot in a vertical plane with respect to the end connector 90A, about pivot pin 60, allowing the truss member 1, when connector 90A is coupled to the corresponding vertical, to swing in a vertical plane, much like a drawbridge (as used, "vertical" is in a plane that passes through and substantially parallels the vertical scaffold member to which the truss is to be joined or the plane that passes through the parallel upper and lower members of the truss, while "horizontal" pivot implies pivoting in a plane substantially perpendicular to that plane containing the upper and lower members). Hence, vertical pivoting implies that the truss members distant end pivots toward or away from the ground, pivoting much like a vertically pivoting railroad crossing guard (e.g., a drawbridge type of action), while horizontal pivoting implies that the truss member swings outwardly from the vertical to which it is attached (much like a swinging hinged gate) without substantially changing its height (e.g. pivoting in a plane parallel to the ground).

Figure 4:
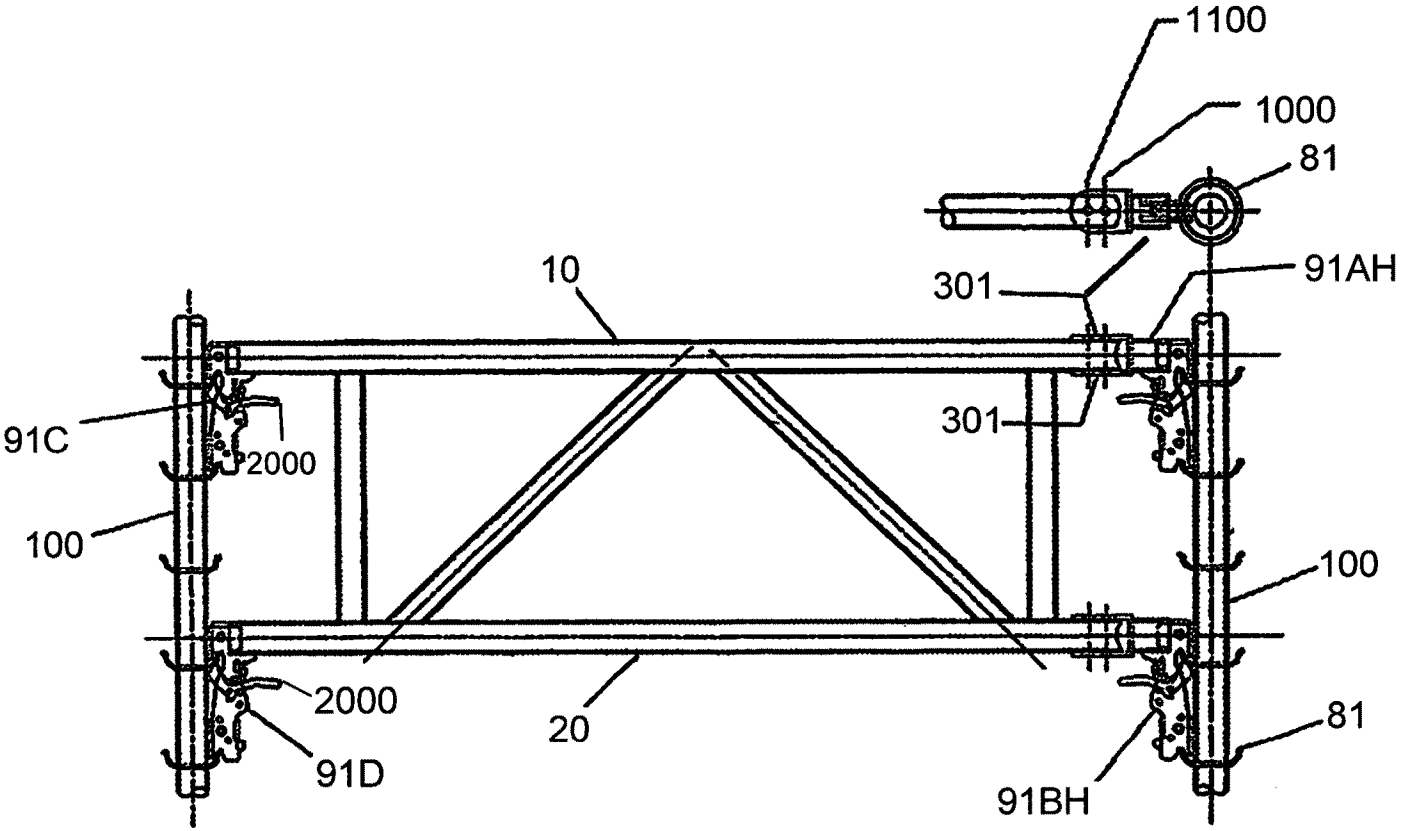
FIG. 4 is a side elevation of one embodiment of a horizontal truss with horizontally pivoting cup/latch connectors.
Figures 5A, 5B:
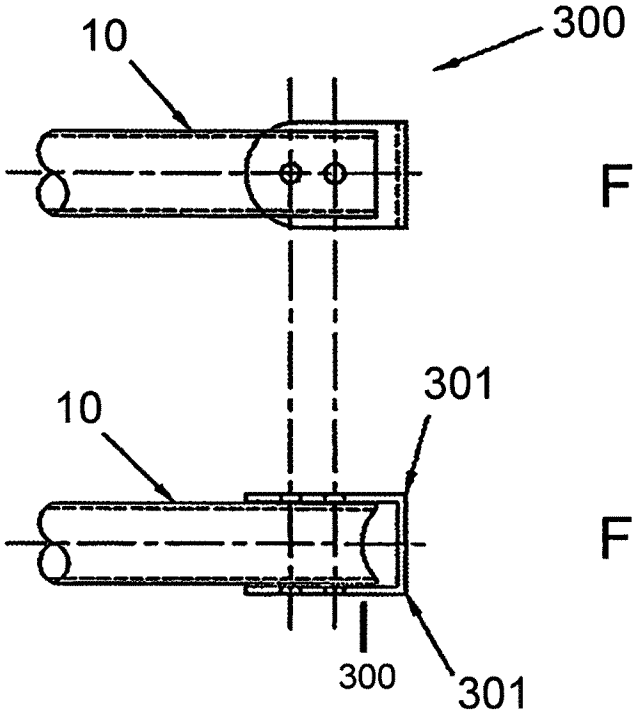
FIG. 5A shows a top view.
FIG. 5B shows a side view of the connector.

To accomplish horizontal pivoting, the horizontal connector body 90A (not shown in FIG. 5) is generally fixedly mounted on a U shaped body 300 having ears 301, shown in FIG. 5. The body 300 then pivots with respect to the horizontal pipe 10 (the horizontal member is positioned interior or between the extending ears 301), by pivoting about a first pivot pin 1000 mounted though ears 301 and horizontal upper pipe 10 at a hinged point (shown in FIGS. 1, 2, 3 and 4. A second pin 1100 may be inserted through the pipe 10 and ears to lock the connector in a non-pivoting configuration about the horizontal pipe 10, forming a locking point (see FIGS. 1, 2, 3 and 4). Other means of allowing the connector to pivot with respect to the pipe could be used, as well as other locking means. For instance, for a horizontal pivoting connector, the connector may be mounted to the exterior (or interior) of the pipe using a bearing. Alternatively, the connector 300 may have a lower ear (not shown) used as a stop which would prevent the pipe from vertically pivoting past the projecting ear. The selected horizontal system horizontal end connect (not shown in FIG. 5) is mounted to (or integral with) the connector body 300.

This truss member 1 will be used to form one side of the extended offset platform. One method follows. A worker, working from the existing scaffold supported platform, such as from a horizontal scaffold deck, will tie a rope to the truss, and suspend the truss upright from the established scaffold structure, or from an overhead structure (such as a bridge member), where the suspended truss upper horizontal 10 is positioned adjacent to the vertical scaffold member to which it is to be coupled, with the couple 90A positioned adjacent to the corresponding joint on the vertical member (here a rosette). The truss member 1 will generally be supported or suspend "above" the corresponding couple rosette point on the vertical that will couple with joint 90A on the suspended truss. The worker will then adjust the rope until the pivoting end of couple 90A on the top horizontal scaffold member 10 is directly adjacent to and insertable into the proper rosette. Preferably, a second worker will then couple the horizontal connector 90A to the vertical connector (e.g. position the mouth of the horizontal connecter body over the rosette by pivoting connector body 300 so that it is at substantially a right angle to the suspended upright horizontal member 10) and then lock the connector in place (drive in the pin through the connector and rosette opening). The first worker then lowers the rope, which results in the downward pivoting of the truss member about the coupled and locked joint 90A, in a vertical plane, until the lower connector body 90B is adjacent to the corresponding rosette on the vertical member. Preferably, the second worker then connects connector 90B with the proper rosette and locks the connector in place. One of the workers may slide the locking pin into the aligned opening in the ears of the upper bracket 300 as a safety measure (not required) to resist further rotation of the truss.

This procedure is repeated on an adjacent vertical of the existing scaffold structure, creating two truss members that are outwardly extending from the adjacent scaffold platform, each supported on one end only. At this point, the worker places scaffold planks between the two extended trusses, forming a working platform deck. In one embodiment of a scaffold plank, each end has downwardly extending U shaped brackets to couple the plank to the respective horizontal (where the horizontal is a circular pipe member). As each plank is about nine inches—a foot wide, multiple planks are slid out over the extended truss members. A worker will then move out on the new deck or platform, carrying a vertical scaffold member. The worker will then attach the vertical to the connectors 90C and 90D, and support the attached vertical to the overhead structure. Preferably, the overhead structure will have a component (such as a first beam) in a vertical plane that passes close to the vertical member to be suspended or the center of the resulting suspended platform (if the beam is substantially off "alignment" with the vertical to be supported, directly supporting the vertical to such a non-aligned overhead beam will not only provide an upward supporting force, but will also provide a horizontal force component, and a large horizontal force component is not preferred). For instance, a chain can be attached (such as looped around the overhead structure) to the overhead structure and tied to an eyebolt fixed or formed at the top of the vertical. A come-along can be used to shorten (or lengthen) the chain to position the truss member in a level position. A second vertical is coupled to the other truss member connectors 90C and 90D, and similarly supported by or suspended from the overhead structure (again, preferably, the overhead structure includes a second component, such as a beam, in a vertical that passes through or close to the center of the extended platform) and then modify the chain length to level the truss, thereby leveling the resulting platform. Horizontals can then be positioned between the two suspended verticals at the rosettes between corresponding 90D joins and 90C joins, to form a three sided suspended frame for the deck or offset working surface. The fourth side of the frame is formed by the ground supported prior existing scaffold frame structure. A single horizontal member may be used to join the two suspended verticals, such as at the level of the upper pipes 10, or the lower pipes 20, or two horizontal members used, one between the upper members, and one between the lower members of the opposing trusses. Additional horizontals may be joined between the suspended verticals, and between the suspended verticals and verticals of the existing scaffold structure, as needed, at a height above the installed deck for a safety rail. Alternatively, the outward vertical (that vertical that will attach to 90C and 90D on the truss members) can be attached to each individual truss member before the truss member is pivotally coupled or installed onto the existing support structure (such as an adjacent scaffold structure), or the outward vertical can be attached immediately after the truss member is pivotally connected to the existing support structure.

When the truss is initially installed and supported only on one end to a single vertical, the truss is supported on that vertical at two spaced apart locations—the upper joint 90A connection and the lower joint 90B connection to the vertical. This double connection creates a strong, stable joint. Additionally, because the truss itself forms a rigid structure, the single extended truss is more stable than a single extended horizontal. Although the truss member is heavier than a single horizontal, the pivoting joint allows the worker to install the truss vertically, reducing the torque forces that would be present in attempting to tie in the truss, or even a single horizontal at ninety degrees to a vertical (as the truss is supported as it is pivoted downward). A grab bar or handle may be included on the truss member to assist in operator manipulation of the truss during installation. Although the invention is described as a pivoting joint on a truss member, a pivoting connector may also be on a single horizontal scaffold member, as opposed to a truss member. While installation is eased with a pivoting horizontal joint, the single horizontal is not as rigid as a truss, and hence is not preferred, but is within the scope of the invention.

As described, the pivoting joint connector is located on the top horizontal of the truss member. As an alternative, the pivoting joint member may be positioned on the bottom horizontal (e.g. joint 90B), but this is not preferred. With a bottom pivoting joint, during installation, the vertically supported upright truss is positioned so the top of the upright truss is positioned adjacent the lower connector on the vertical, with the lower horizontal 20 immediately adjacent the vertical scaffold member. However, in this configuration, the vertically suspended truss 1 is generally suspended below the rosette or annular member that will couple with joint 90B, and hence the suspended truss, once the couple with 90B is established, must now be rotated or pivoted "upwardly" to allow the connector 90A on the top horizontal 10 to come into alignment with the upper connector on the vertical member (as opposed to "lowering" the vertically suspended truss from a pivoting connector on the top horizontal). This raising movement is considered more arduous, and hence, the pivoting bottom connector 90B is not preferred.

Figure 2:
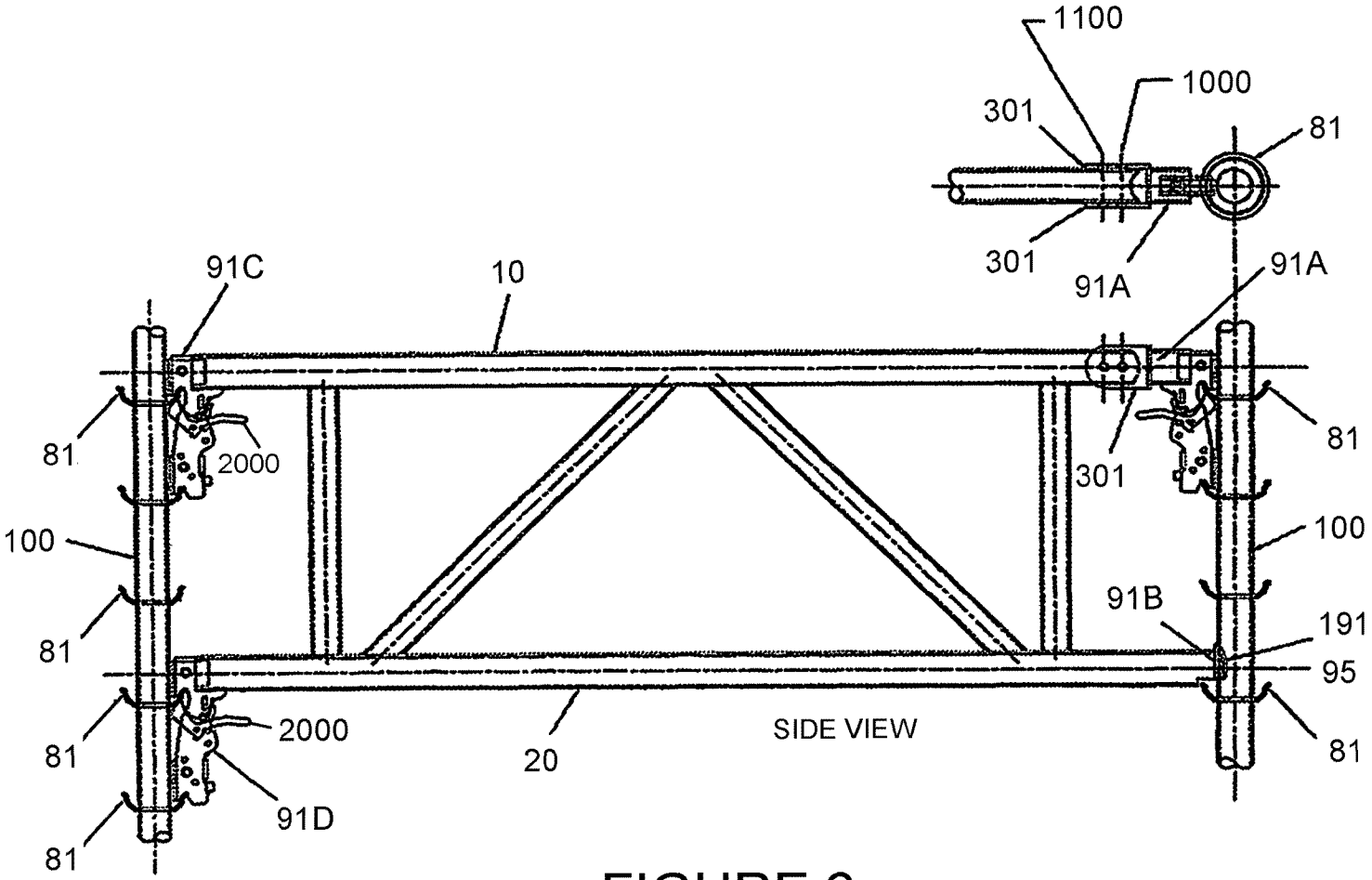
FIG. 2 is a side elevation of one embodiment of a horizontal truss with a vertically pivoting cup/latch connector.

A second vertically pivoting truss is shown in FIG. 2, however, shown in this truss member is a pivoting join on the horizontal that is of the cup/latch type of join. In the embodiment shown in FIG. 2, the truss contains only three connectors, pivoting connector 91A, and non-pivoting connectors 91C and 91D. Shown attached to the lower truss member at location 91B is an arcuate shaped body 95, a couple member, shaped to mimic the outer curvature or shape of the vertical scaffold pipe. "Arcuate" will be used to indicate that couple member's shape is comparable to that of the vertical for support by that vertical (for instance, if the vertical is square, "arcuate" indicates the couple member is shaped to rest on the vertical—i.e. forms three sides of a square). With a annular cup 81 engagement (as opposed to the flat annular rosette), a connecter positioned on the lower truss member cannot properly engage the cup 81 by pivoting into place, as the front of the hook type connector, in a pivot action, would contact the exterior surface of the cup 81. Hence, the couple member is designed to engage and support the truss against the vertical scaffold member without using a connector to connect to a cup. The couple member 95 is preferably shaped to rest on a vertical member and help support the truss member. Couple member could also be a clamp positioned around the vertical and joined to the lower horizontal, such as a pivoting clamp. Couple member may also be two parallel opposing plates so that when the truss is installed, the vertical member is trapped between the two parallel plates (not shown). Alternatively, but not preferred, both ends of the lower horizontal could terminate in a couple member, such as an arcuate shaped coupled member, a clamp, etc.

If two cup type connectors are desired to attached to spaced apart cups, a horizontally pivoting embodiment may be used (as later described), or the bottom connector at position 91B should be slidable vertically with respect to the horizontal member 20, so that the lower connecter 91B can be moved vertically upwardly, to clear the cup, then downwardly to engage the cup; alternatively, in some connector embodiments, instead of sliding vertically, the second end connector on lower horizontal may be rotatable about an axis aligned with the center of the horizontal member, thereby allowing the second end connector to be positioned adjacent the corresponding cup or rosette or other connector on the vertical, and rotated into proper coupling orientation (not shown). The horizontal position of such a rotatable or vertically slidable horizontal end connector preferably is lockable, such as with a pin, to prevent unwanted movement after engagement with the respective cup or rosette.

The truss member 1 is used to assemble an extended, vertically supported platform as the previous connector. Once one suspended offset platform is in place, this offset platform may now be used as the "fixed" scaffold, and another extended offset platform may now be attached, using a similar construction technique. For instance, if a 30×10 foot extended platform is needed off of an "fixed" scaffold frame, the first ten foot extended offset platform is erected as an outwardly extending platform to create a 10×10 offset platform. After this extension has been vertically supported, a second offset ten foot platform is built connected to the first offset platform at overhead supported end, thereby creating a 10×20 foot vertically supported offset platform, and so on until the desired length is reached (the suspended platform may also be 20×20, having three parallel trusses each 10 feet across, etc.). Breakdown or disassembly of the platform is performed in substantially the reverse order as assembly.

Figure 3:
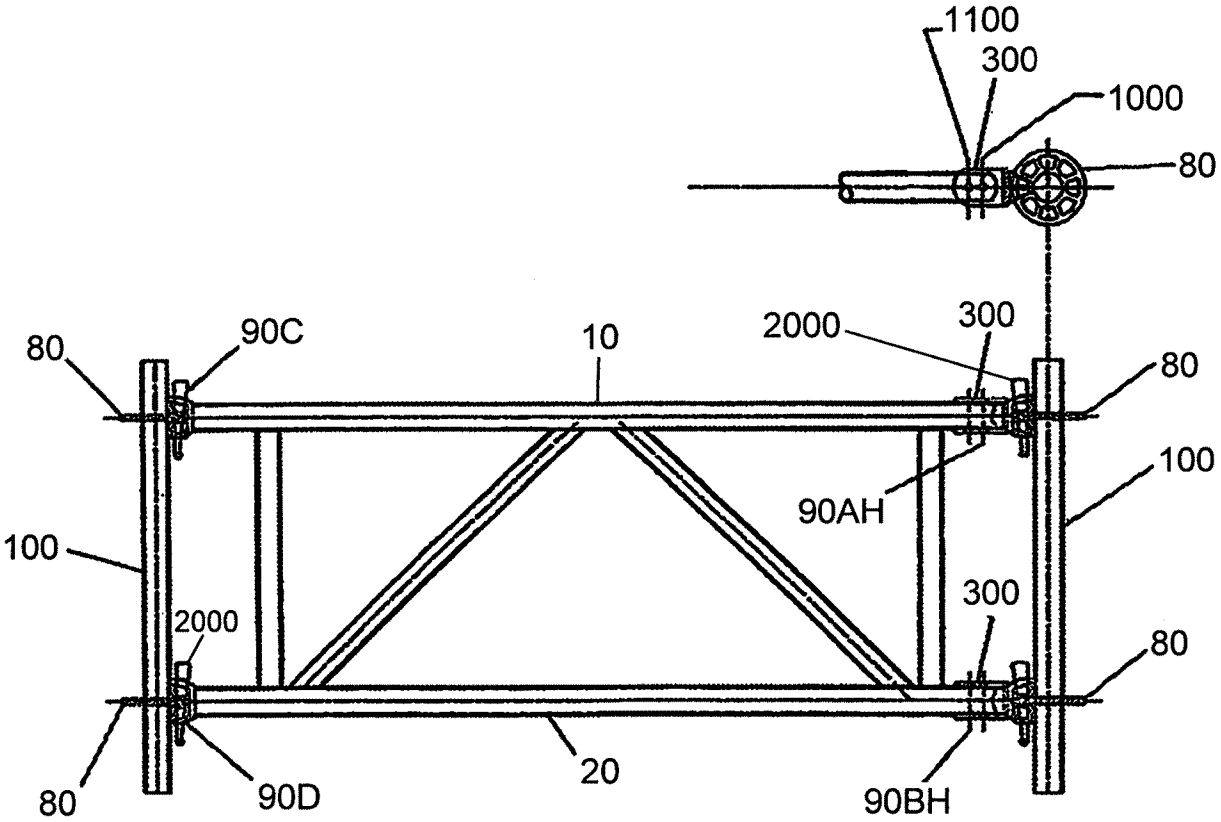
FIG. 3 is a side elevation of one embodiment of a horizontal truss with horizontally pivoting pinlock connectors.

A third type of pivoting truss member is shown in FIG. 3. Shown here is a truss member 1 having pivoting connectors 90AH and 90BH. However, these connectors are designed to pivot in the horizontal plane (like a swinging fence gate), where "horizontal plane" is a plane ninety degrees to the orientation of a vertical member (e.g. parallel to the ground). Again, the preferred construction is to have the horizontal members 10 and 20 attached to a U shaped bracket 300, and the bracket 300 pivots with respect to the horizontal members 10 and 20. In this instance, the ears 301 of the bracket 300 are positioned on "top" and "bottom" of the horizontal members s 10 and 20 to provide for horizontal pivoting (whereas the vertically pivoting truss has the ears mounted on the "sides" of the horizontal members).

To build an offset vertically supported platform with this truss, the truss is installed in its natural orientation, horizontally. To avoid torque forces, the truss should be horizontal but not extending outwardly from the scaffold frame. Instead, the truss should be oriented so that it is adjacent the side of the scaffold platform. In this orientation, a worker can support the truss with almost no torque forces, if supported from the center of the truss (overhead support is not necessary). To attach, one worker supports the truss and connectors 90AH and 90BH are pivoted to face the respective annular members 80 for engagement and mounting. One worker holds the truss, while a second worker aligns the two truss connectors 90AH and 90BH with the respective connectors 80 on the vertical scaffold member, and joins the truss connectors to the vertical connectors and locks the connectors in place. The second horizontally pivoting truss is similarly installed on an adjacent vertical. The installed trusses are rotated horizontally (swung outwardly) until they extend outwardly and generally are perpendicular to the scaffold frame. As in the other methods, decking is laid, verticals are attached to the remote ends of the truss, and the verticals supported from an overhead structure. A similar horizontally pivoting truss in a cup/latch embodiment is shown in FIG. 4.

Figure 2A:
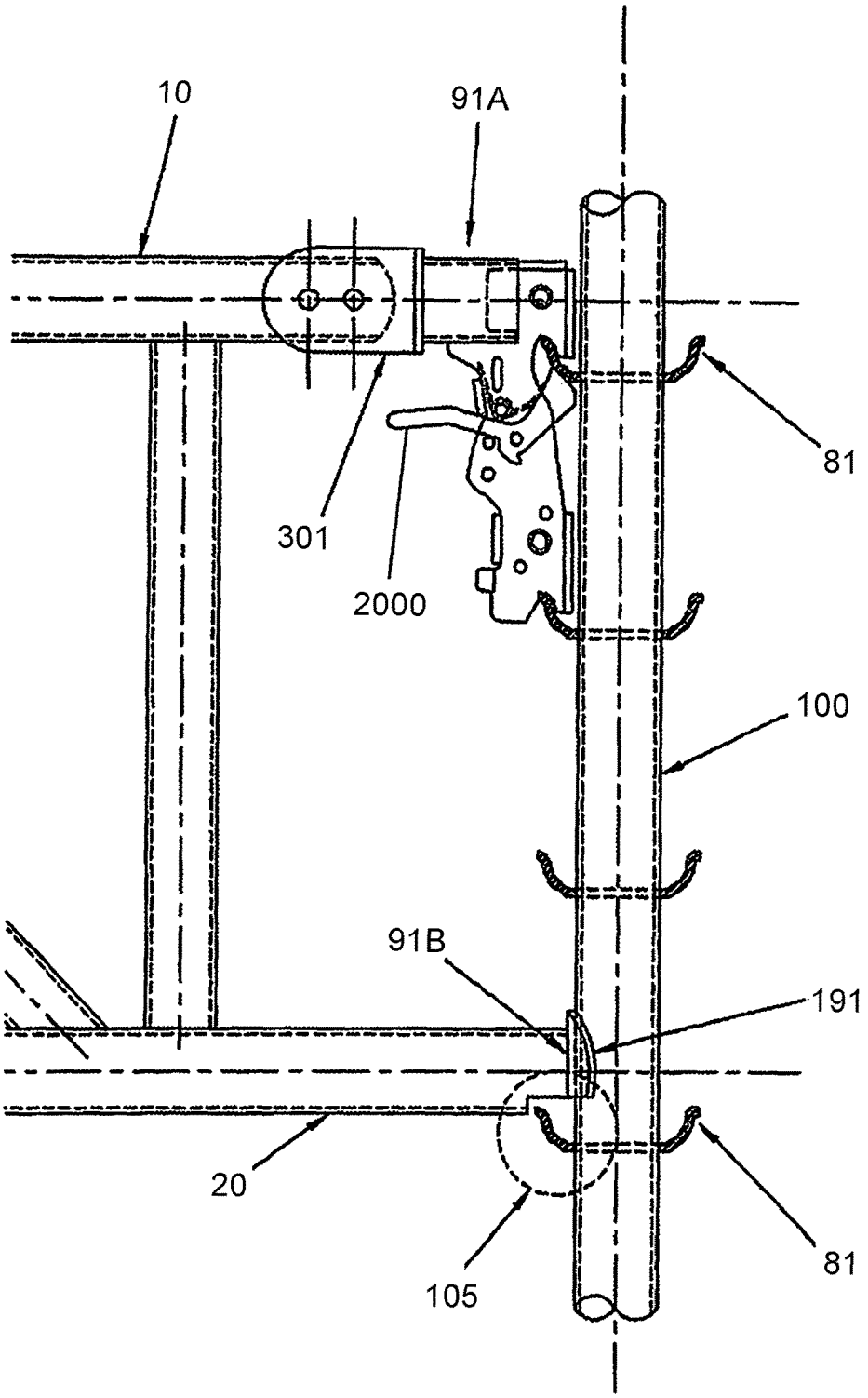
FIG. 2A is a side elevation partial view of truss end of FIG. 2.
Figure 6:
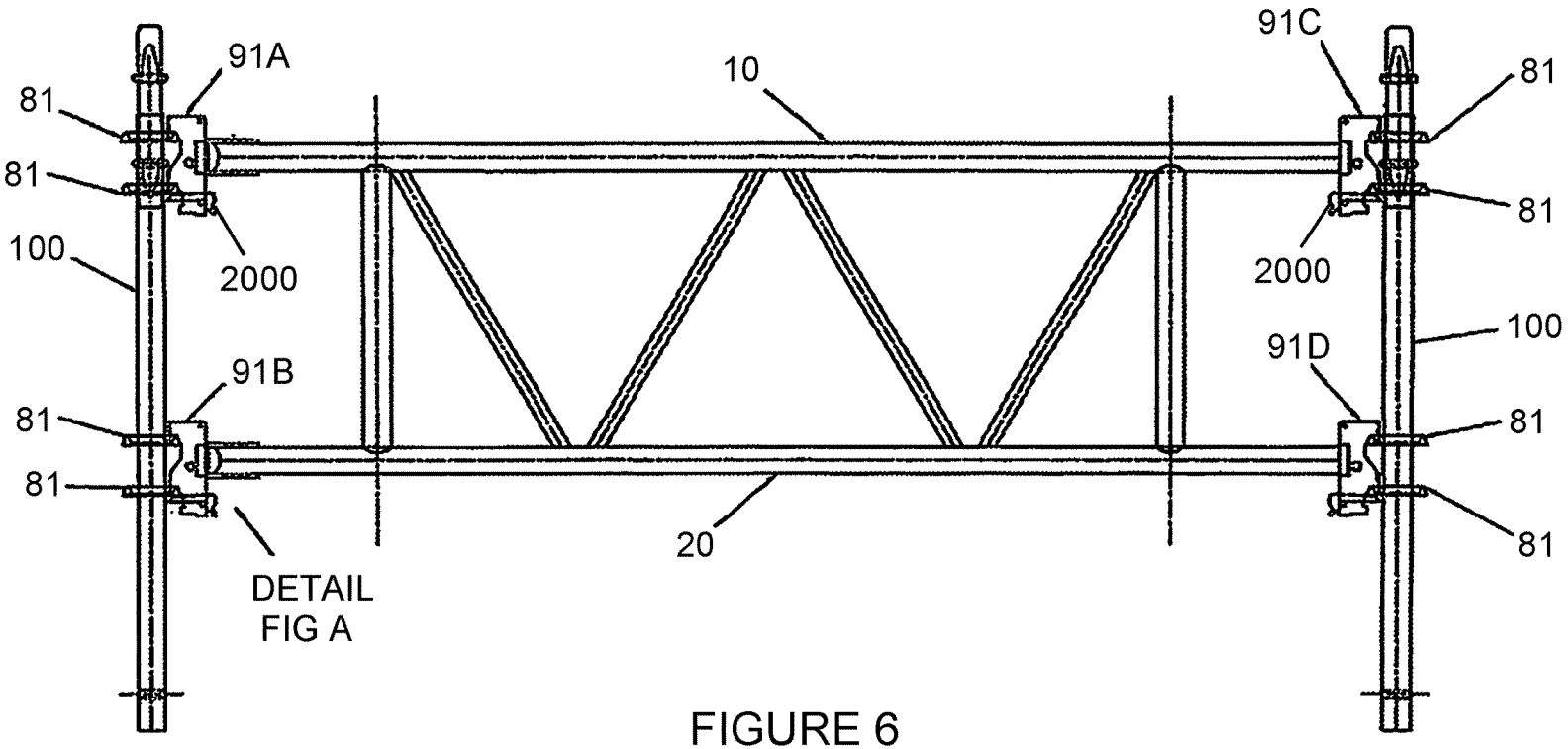
FIG. 6 is a side elevation of one embodiment of a pivoting horizontal truss with a cup/slidable latch connector.
Figure 6A:
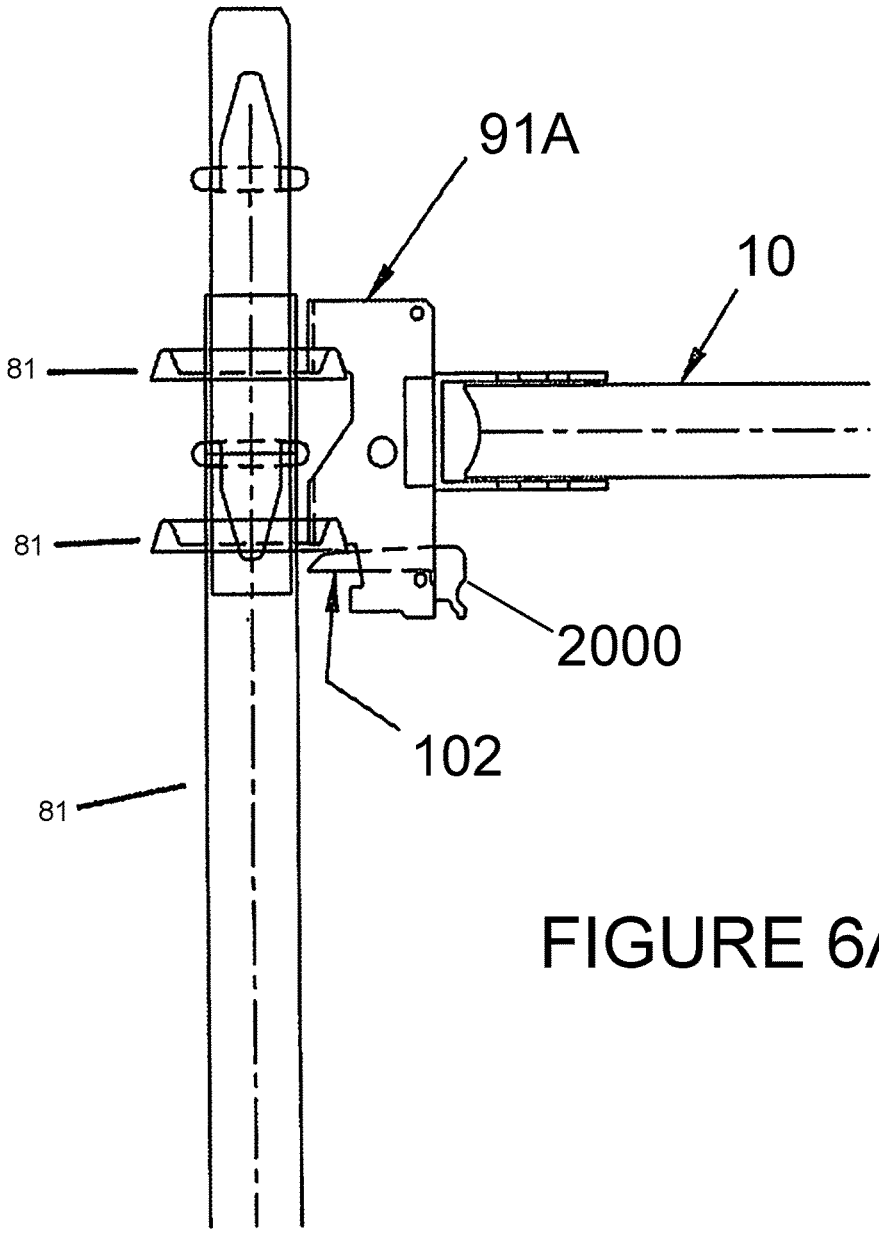
FIG. 6A is a detailed view of end connector 91A on the truss embodiment of FIG. 6.

Another horizontally pivoting truss embodiment is shown in FIG. 6, using end connectors similar to that shown in U.S. Pat. No. 4,445,307. In this embodiment, the latch or lock member does not pivot with respect to the end connector, but is slidable with respect to the end connector (such as a wedge 102 that is slid into position underneath the respective cup in an assembled scaffold joint). In the truss shown in FIG. 6, the two horizontal members 10, and 20 each have horizontally pivoting end connectors 91A and 91B. Pivoting end connectors are not required on the other end of the truss member. This truss is installed similarly to the truss described in FIG. 3. This end connector type may also be used in a vertically pivoting truss embodiment, but as with the vertically pivoting truss cup/latch system shown in FIG. 2, the bottom end of the truss adjacent the top pivoting member preferably will not terminate in an end connector, but instead, with a couple member (such as an arcuate shaped member if the vertical is a circular pipe) that will bear against the vertical scaffold member. For instance, the arcuate shaped member 191 may be a half cylinder, with an inner radius equal to that of the outer radius of a vertical scaffold pipe 100, or the couple member could be a clamp, or some combination. As shown in FIG. 2A, the end of the lower horizontal member 20 also has a lower cutout 105 to accommodate the adjacent cup 81 on the vertical scaffold member 100. If additional security in the connector is required, a clamp may be used to secure the arcuate shaped member to the vertical scaffold member, such as a pivoting "U" bolt clamp pivotally attached to the horizontal lower member 20 or the arcuate shaped end.

Figure 7:
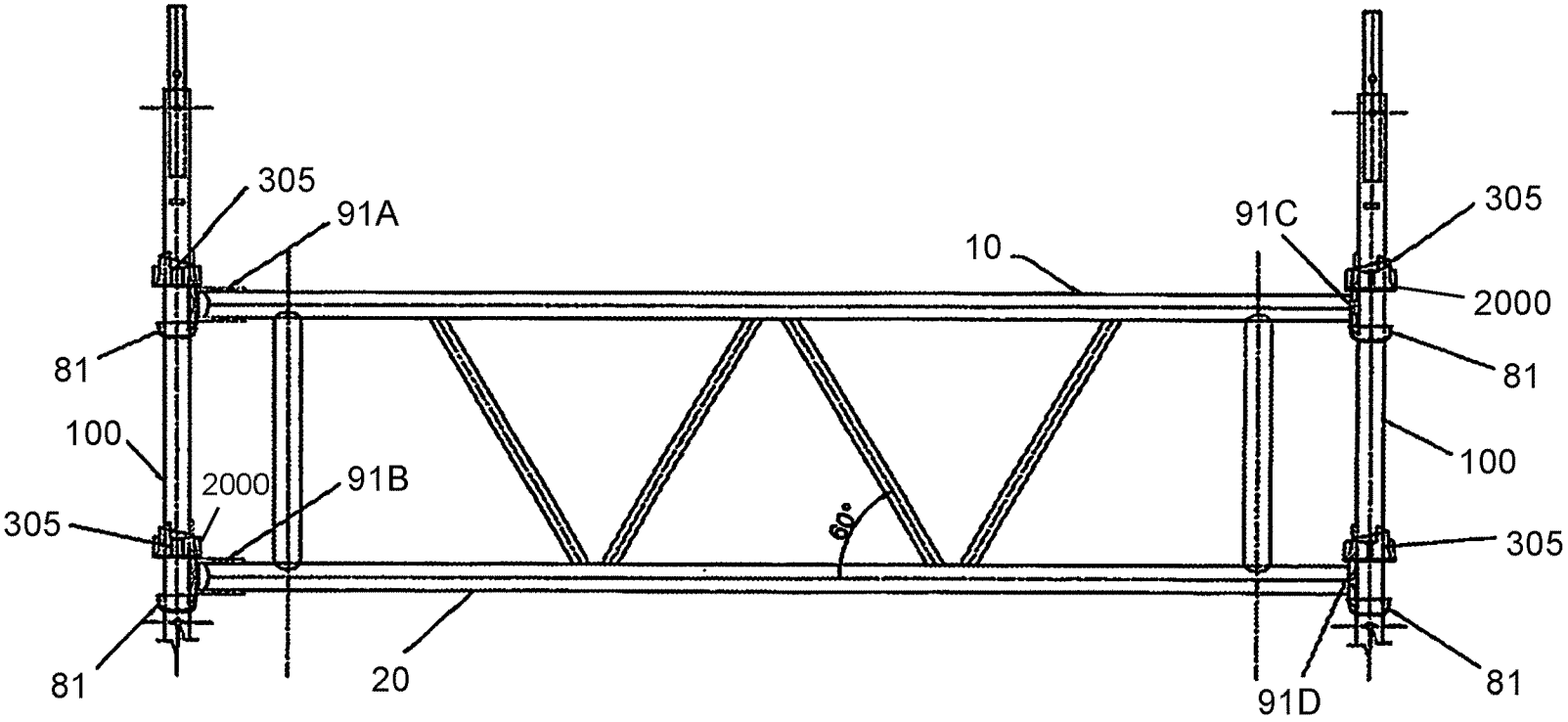
FIG. 7 is a side elevation of one embodiment of a pivoting horizontal truss with a cup and cup lock connector.
Figure 7A:
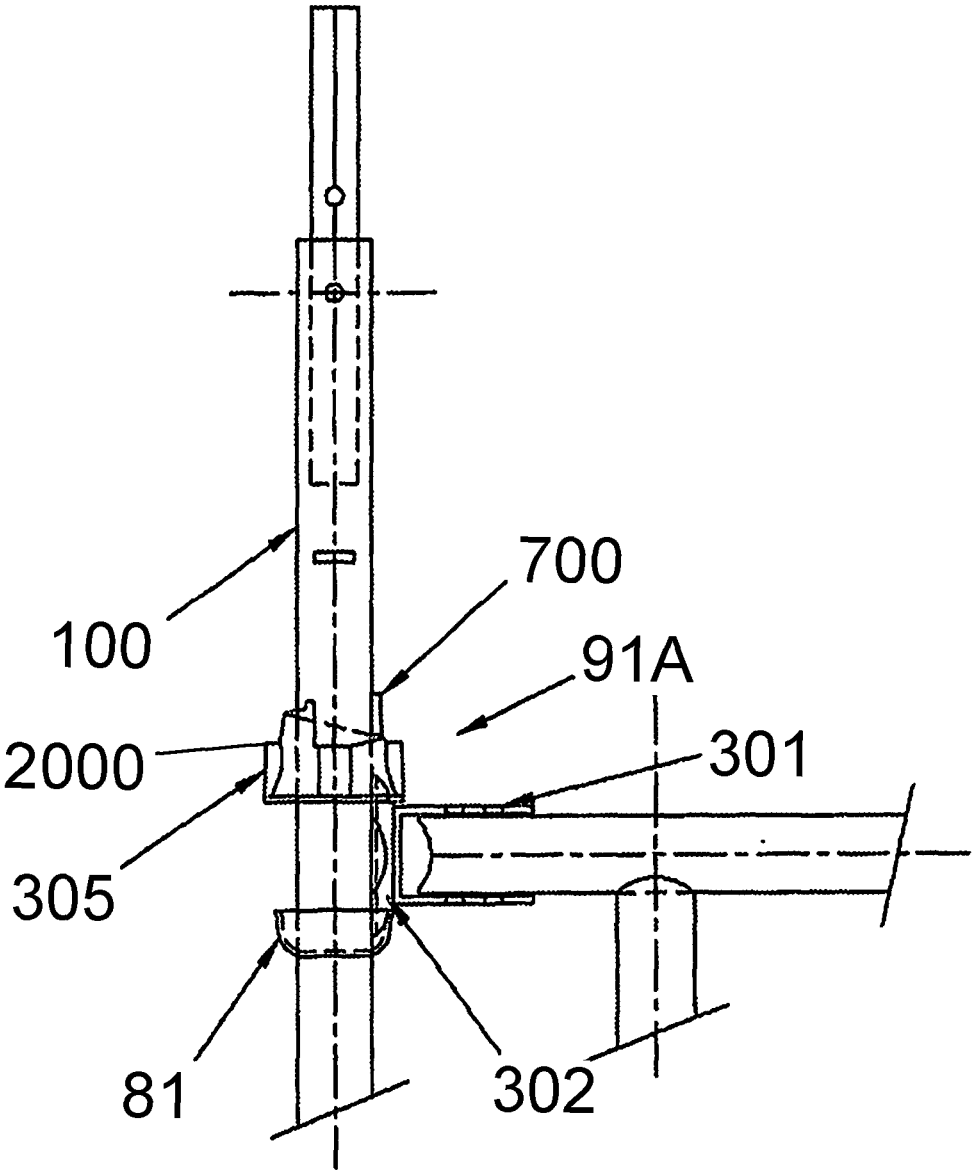
FIG. 7A is a detailed view of end connector 91A on the truss embodiment of FIG. 7.

Another pivoting end connector truss embodiment is shown in FIG. 7, using end connectors similar to those in U.S. Pat. No. 3,992,118. The pivoting end connectors 91A and 92B are horizontally pivoting end connectors—the end connector on the horizontal is basically a pivoting short piece of pipe terminating with an upwardly extending tongue member 301 and downwardly extending tongue member 302. As previously described, the upper 91A and lower 91B pivoting end connectors at one end of the truss are placed in the annular channels of the corresponding upstanding cups 81 or annular member on a vertical 100 (e.g. the downward extending tongues 302 are positioned in the annular channel formed by the upstanding cups 81) and then locked into place (here by sliding the reverse cup 305 on the vertical downward, with the slot in the reverse cup 305 aligned with lug 700 on the vertical member. The reverse cup 305 is slid sufficiently far down the vertical to extend past the lug 700, after which the reverse cup 305 is rotated to misalign the slot on the end connector with the lug 700 on the vertical member 100, thereby capturing the upstanding tongue 301 on the pivoting end connector in the annual ring of the reverse cup 305. Once the horizontal end connector is coupled with the end connector on the vertical, the truss is then swung or pivoted outwardly like a swing gate into the proper orientation with the scaffold frame.

This end connector type (cup lock) may also be used in a vertically pivoting embodiment, but as with the vertically pivoting truss cup/latch system shown in FIG. 2, the bottom end of the truss adjacent the top pivoting member preferably will not terminate in a pivoting end connector. However, in the cuplock system, the horizontal end connector tongues may have suitable curvature to form the preferred arcuately couple member, suitably adapted (e.g. the downward facing tongue may not be present on this couple member to avoid interference with the corresponding cup on the vertical). Instead of an arcuate shaped couple member (or as a supplement to) a clamp or similar attachment can be positioned on the bottom end connector, which would then be clamped to the vertical scaffold member after the truss has been vertically swung into position, when the clamp would be adjacent to the vertical scaffold member.

As described, the pivoting truss system can be used with most connector types, including traditional tube and clamp scaffolding. Scaffold pipes may be round or other shape. Each connector is configured to "connect" with an annular member on a vertical scaffold member—that is, when the connector engages the annular member, the join supports the truss (the truss may rotate, for instance, but the truss is nevertheless supported by the engagement or connection). The connection may automatically "lock" the vertical to the horizontal (such as in the Excel type spring loaded latch type connectors), or may require action on the part of the operator to lock the horizontal to the vertical (such as in the cup-lock type of connectors, the Safway type of connectors, or the pinlock type of connectors).

Figure 8:
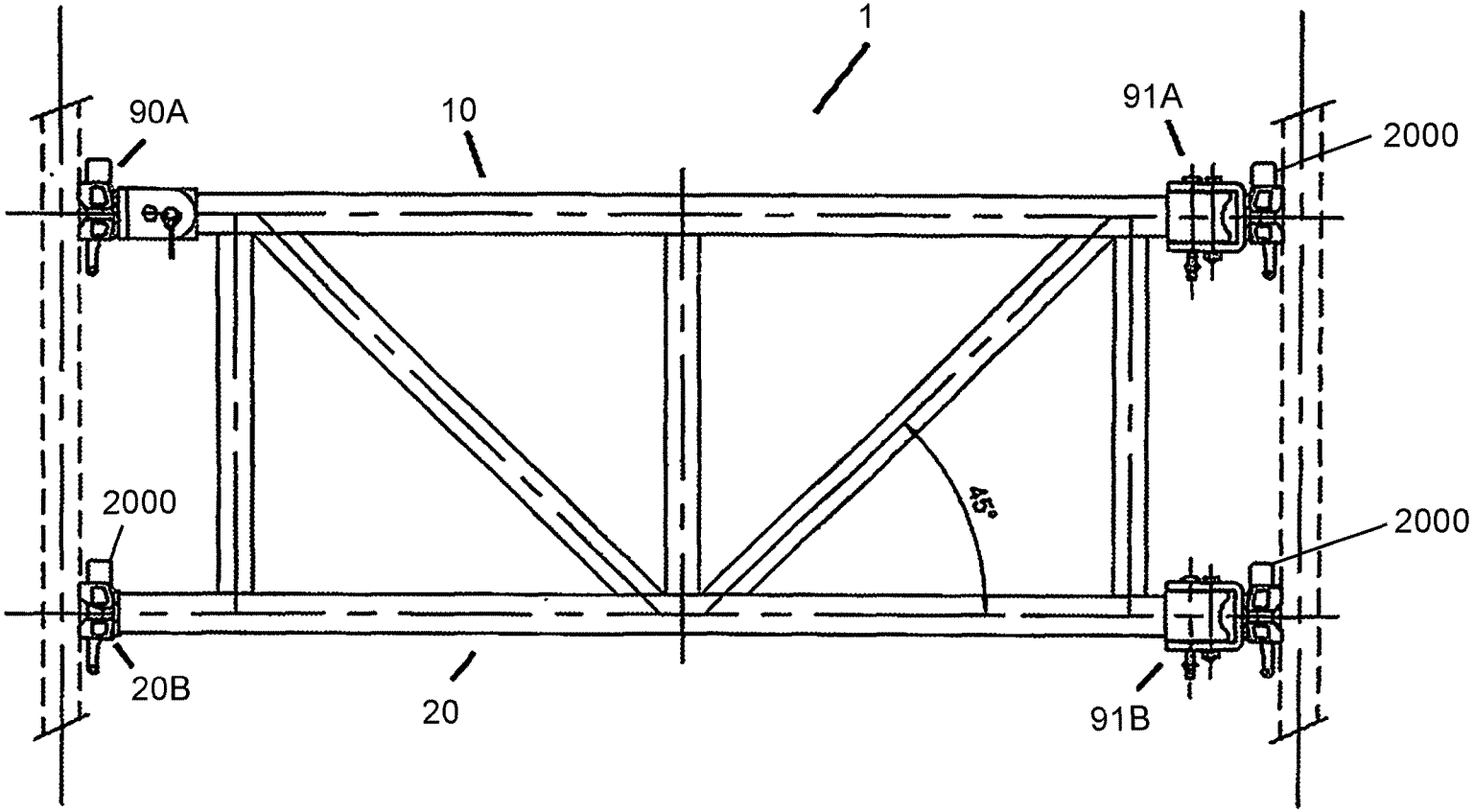
FIG. 8 is a side view of one embodiment of the truss having both horizontal and vertical pivotable connectors.
Figure 9:
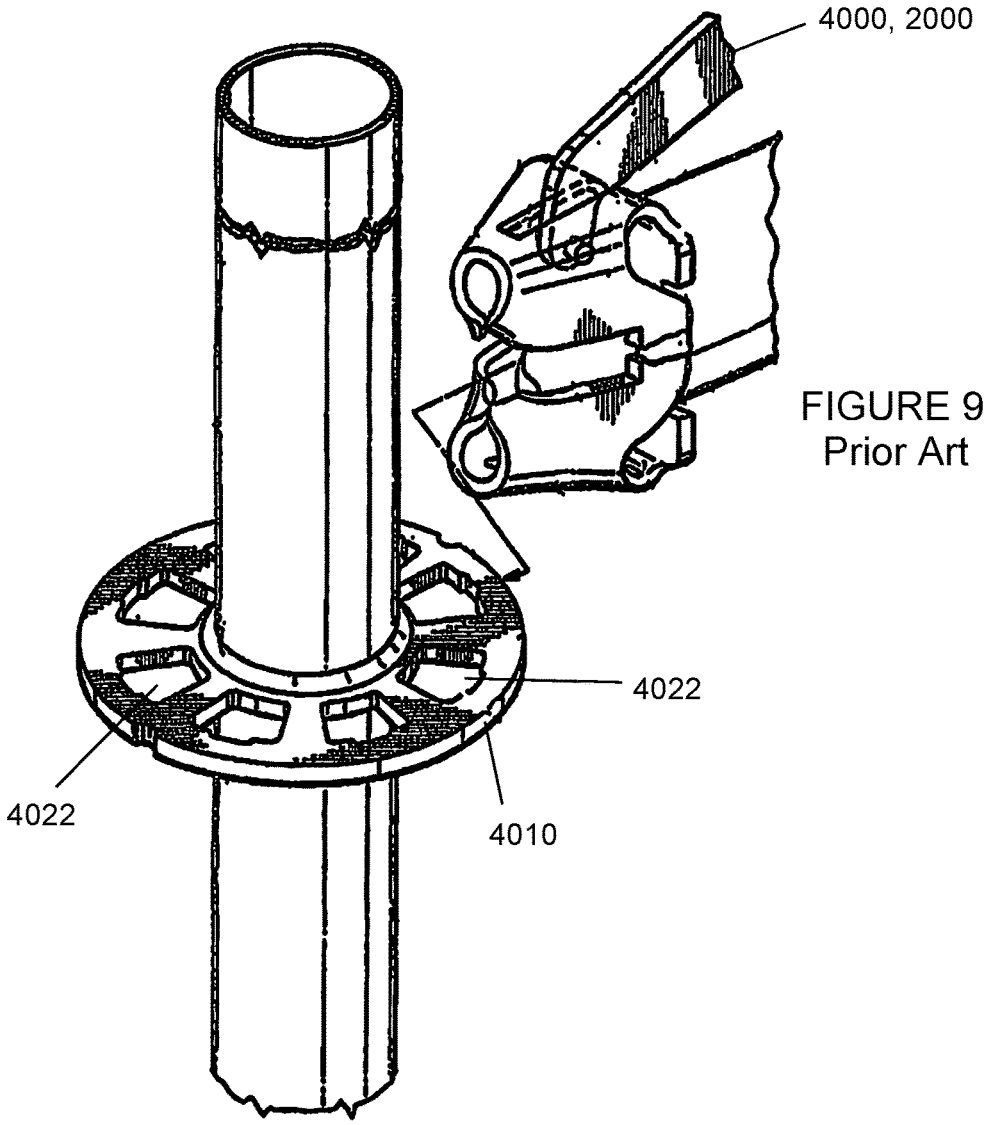
FIGURE 9 Prior Art
FIG. 9 is a perspective view of one embodiment of a pin lock type scaffold joint (taken from FIG. 1 of U.S. Pat. No. 5,961,240).

Another embodiment of the truss member is shown in FIG. 8. As shown in this figure, truss member 1 has connectors 90A, 90B, 91A and 91B that are pin lock type connectors. Connector 91 A is mounted to the upper member 10 and is mounted to allow the truss member 1 to pivot vertically. Connector 90B is fixedly attached to lower member 20 on the same truss end as connector 90A, and does not pivot. The opposite end of truss member 1 has connectors 91A and 91B attached to the upper and lower members respectively, and are configured to allow the truss member to pivot in the horizontal plane. This "dual" pivoting truss allows a single truss member to be used at the user's discretion for vertical or horizontal pivoting, thus eliminating the need to keep separate inventory of two different types of truss members. The "dual" pivoting truss can be used with end connectors other than pin lock type, as described previously.

It is understood that others have tried to use a system where the entire horizontal member, including the connector, pivots in the vertical connector (generally, a rosette). However, in such a system, the standard openings in the rosette cannot be used, as the openings in the standard rosette are designed to tightly couple the horizontal to the vertical. Hence, non-standard rosettes must be used, and hence, non-standard verticals. One of the benefits of the present system is that the standard vertical connector and standard horizontal connect can be used with no modifications, as the connector pivots with respect to the horizontal pipe. For pinlock type of connectors for vertical pivoting, the jaws of the opening on the truss member fixed connector may be widened to assist installation (see FIG. 1, where the upper 1000A and lower jaw 1000B are not parallel, but the upper jaw 1000A is set at an angle (here 28 degrees).

The truss member connectors described as being fixedly attached to the upper or lower pipe may also be pivotally attached. As described above, the pivoting truss member is used to erect an overhead supported offset scaffold deck. The pivoting truss member is not limited to that application, as there may be applications where the stiffness and extra support of a truss member is needed in a non-overhead supported scaffold structure, and the pivoting truss allows for ease of installation in such applications.

The invention claimed is:

1. A scaffold horizontal truss, said scaffold horizontal truss comprising an upper horizontal member and a lower horizontal member, each separated from the other but fixedly joined with at least one bracing member forming a truss frame, each horizontal member having a first and second end respectively, first connectors, configured to removably connect to a first tubular scaffold vertical member at an annular member that is fixedly positioned on and extending outwardly from said first tubular scaffold vertical member, said first end of said lower and upper horizontal members having one of said first connectors attached thereon;

a plurality of second connectors each configured to removably connect to a second tubular scaffold vertical member at an annular member that is fixedly positioned on said second tubular scaffold vertical member and extending outwardly from said second tubular scaffold vertical member, said plurality of second connectors being pivotally attached on said second ends of said upper and said lower horizontal members whereby each second connector is pivotable in a horizontal plane with respect to said truss frame;

each of said second connectors having a moveable latch member moving between a latched position and an unlatched position, whereby in said latched position, when said respective second connector is coupled to an annular member on said second tubular vertical scaffold member, said latch member resists decoupling of said respective second connector from the annular member but said second connector remains pivotable with respect to said truss frame.

2. The scaffold horizontal truss of claim 1, wherein one of said first connectors is fixedly non-pivotally attached on said first end of said upper or lower horizontal members.

3. The scaffold horizontal truss of claim 1 wherein said annular members comprise an upstanding cup or rosette.

4. The scaffold horizontal truss of claim 3 wherein said at least one bracing member comprises at least four bracing members.

5. The scaffold horizontal truss of claim 1 wherein said latch members are either slidable or pivotable.

6. The scaffold horizontal truss of claim 1 wherein said second connectors are configured to removably connect to said second tubular scaffold vertical member at an annular member comprising a rosette having an opening and where said latch member is slidable in said rosette opening.

* * * * *